US010045569B2

(12) United States Patent
Caden

(10) Patent No.: US 10,045,569 B2
(45) Date of Patent: Aug. 14, 2018

(54) GARMENT FOR CONTAINING MOISTURE COMPOSITIONS

(71) Applicant: JKL IP Company LLC, Birmingham, MI (US)

(72) Inventor: Jodi E. Caden, Bloomfield Hills, MI (US)

(73) Assignee: JKL IP COMPANY LLC, Sherman Oaks, CA (US)

( * ) Notice: Subject to any disclaimer, the term of this patent is extended or adjusted under 35 U.S.C. 154(b) by 420 days.

(21) Appl. No.: 14/540,503

(22) Filed: Nov. 13, 2014

(65) Prior Publication Data

US 2015/0133031 A1 May 14, 2015

Related U.S. Application Data

(60) Provisional application No. 61/903,673, filed on Nov. 13, 2013, provisional application No. 61/945,294, filed on Feb. 27, 2014.

(51) Int. Cl.
*A41C 1/08* (2006.01)
*A41D 1/21* (2018.01)

(52) U.S. Cl.
CPC ..... *A41C 1/08* (2013.01); *A41D 1/21* (2018.01); *A41D 2300/22* (2013.01); *A41D 2400/60* (2013.01)

(58) Field of Classification Search
CPC ... A41D 1/06; A41D 1/08; A41D 1/10; A41C 1/10
USPC ..... 450/155; 2/69, 227, 228, 238
See application file for complete search history.

(56) References Cited

U.S. PATENT DOCUMENTS

| | | | | |
|---|---|---|---|---|
| 2,513,039 | A * | 6/1950 | Miller | A41B 9/004 2/406 |
| 2,854,006 | A * | 9/1958 | Geimer | A41C 1/10 450/117 |
| 4,596,253 | A | 6/1986 | Griffith | |
| 4,789,372 | A | 12/1988 | Wicks | |
| 5,431,030 | A | 7/1995 | Ishizaki et al. | |
| 5,533,961 | A | 7/1996 | Iwata | |
| 5,762,535 | A | 6/1998 | Nishiyama et al. | |
| 5,787,512 | A | 8/1998 | Knox | |
| 6,146,240 | A | 11/2000 | Morris | |
| 6,272,888 | B1 | 8/2001 | Fujita et al. | |
| 6,401,497 | B1 | 6/2002 | Nishiyama et al. | |
| 6,817,034 | B2 | 11/2004 | Smilovic | |
| 7,074,204 | B2 | 7/2006 | Fujii et al. | |
| 7,559,093 | B2 | 7/2009 | Sudo et al. | |

(Continued)

*Primary Examiner* — Gloria Hale
(74) *Attorney, Agent, or Firm* — Stetina Brunda Garred and Brucker; Mark B. Garred

(57) ABSTRACT

The present invention contemplates a garment comprising a band to be worn around a woman's torso, such as underneath a traditional garment top. The band comprises a stretchable compressive material having a generally cylindrical shape and one or more ribbing sections. The band may encircle the user's torso to cover at least a part of a protruding belly portion or skin and at least a portion of the user's back. The one or more ribbing sections may be worn underneath the protruding belly portion, providing support. The garment may serve to protect traditional garment tops, confine specialty skin products to the user's torso, or act as an extension of a traditional garment top to avoid exposure of skin.

20 Claims, 7 Drawing Sheets

(56) References Cited

U.S. PATENT DOCUMENTS

| | | | | |
|---|---|---|---|---|
| 7,614,256 | B2 | 11/2009 | Mitchell | |
| 7,631,366 | B2 | 12/2009 | Oyama et al. | |
| 7,631,521 | B2 | 12/2009 | Oya | |
| 7,670,205 | B2 | 3/2010 | Oyama et al. | |
| 7,677,953 | B2 | 3/2010 | Oyama et al. | |
| 7,685,651 | B2 | 3/2010 | Yoo | |
| 7,730,552 | B2 | 6/2010 | Ota et al. | |
| 7,908,670 | B2 | 3/2011 | Semba et al. | |
| 8,603,549 | B1 * | 12/2013 | Baker | A61Q 19/06 424/402 |
| 2004/0049834 | A1 | 3/2004 | Stangle et al. | |
| 2007/0149093 | A1 | 6/2007 | Lutz | |
| 2008/0295217 | A1 * | 12/2008 | Hendrickson | A41D 1/20 2/69 |
| 2009/0270012 | A1 | 10/2009 | Melarti et al. | |
| 2012/0302133 | A1 | 11/2012 | Melarti et al. | |
| 2013/0165018 | A1 * | 6/2013 | Barker | A61F 5/03 450/95 |
| 2015/0038050 | A1 | 2/2015 | Melarti et al. | |
| 2015/0320121 | A1 * | 11/2015 | Fligel | A41C 1/10 450/155 |

* cited by examiner

GARMENT FOR CONTAINING MOISTURE COMPOSITIONS

TECHNICAL FIELD

The present invention pertains generally to apparel, and more particularly to a stretchable and/or compressive undergarment, which can be worn underneath traditional garments.

BACKGROUND

It is not uncommon for a person to feel self-conscious of his or her body. During periods in their lives, men and women may undergo drastic bodily changes. For example, during a stressful period or a period of dieting and exercise, a person may gain or lose extreme amounts of weight. Weight gain may lead to unsightly lumps, bumps, and stretching of skin, which may even be visible to others if the person is wearing tight or dingy garments. Weight loss may lead to sagging skin, for example. In addition, individuals undergoing particular surgeries, such as bariatric surgery, may experience rapid weight loss.

The shape of a woman's body also changes dramatically during pregnancy, and even after pregnancy and considerable time and effort may be required to return to pre-pregnancy measurements. In particular, the pregnant woman's belly goes through several phases, expanding and retracting over a period of time, which is relatively short in comparison to some non-pregnancy related weight gains and losses. The woman's skin, in particular around the belly area, stretches during pregnancy often leaving unfavorable marks or lines, more commonly known as stretch marks. During or after pregnancy, a woman may also notice weight gain, stretch marks, sagging skin, and/or a dimpled or lumpy appearance in other areas of her body such as her buttocks, hips, and thighs.

Many men and women therefore seek to reduce the appearance of the sagging skin, dimples and/or lumps, and may also desire additional coverage of their bodies. In addition, many people use specialty skin products to prevent and reduce these stretch marks but are limited by when these types of products can be applied. Traditional garments can rub against the skin, causing specialty skin products to dissipate from the area in which it was applied, reducing the effectiveness of the product. Additionally, many of these specialty skin products contain ingredients that can deteriorate or discolor traditional garments or compression garments such as wraps worn around the belly during or post-pregnancy or after surgeries. People are limited to using these specialty skin products at home or in private where they can be nude.

During these dramatic changes to a woman's or a man's body, traditional tops, such as blouses or shirts may not provide total coverage of skin. For example, a growing pregnant belly may lift these tops up, thereby allowing for skin to be exposed between the bottom of the shirt and the waistband of bottoms, such as pants or a skirt. Also, as the pregnant belly grows, or as additional weight is added to the torso region, the belly is pulled downward, which can cause pain or discomfort for the person, especially in his or her lower back.

There is thus a need for addressing or ameliorating one of more of the disadvantages associated with the dissipation of specialty skin products, lumpy or dimpled appearance, and a lack of coverage or support for a belly (e.g., a pregnant woman's belly).

SUMMARY

The present invention meets one or more of the above needs by the improved devices and methods described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description. In addition, while the teachings herein may include reference to a woman and/or a pregnant belly, the teachings herein are not limited to women or for use during pregnancy or immediately after pregnancy. These teachings envision use by both men and women who are not pregnant and may require additional support for the weight of his or her belly; desire smoothing and/or additional coverage; use specialty creams, gels or lotions; or any combination thereof.

The garment disclosed herein may comprise a band intended to be worn around at least a portion of a person's torso underneath a traditional garment top or a compression garment. The garment may comprise a stretchable and/or compressive material having a generally cylindrical shape in at least a portion of the garment and one or more ribbing sections. The one or more ribbing sections may extend 360 degrees or less around the garment. The garment may further comprise a moisture locking material. The garment may encircle the person's torso, covering at least a part of his or her protruding belly portion and at least a part of the person's back. The one or more ribbing sections may be worn underneath a protruding belly portion to provide support (e.g., underneath a woman's pregnant belly). The garment may further comprise ruching of the stretchable and/or compressive material on a portion of the garment, such as the band, covering the person's back. The garment may comprise one or more areas of ruching of the stretchable and/or compressive material on the portion of the garment covering the person's back. The ruching may allow the garment to expand vertically in an area covering at least a part of the belly portion (e.g., a protruding belly portion) while preventing the garment from expanding in the portion of the garment covering the person's back. The garment may form its generally cylindrical shape from one or more seams joining the fabric of the garment.

It is contemplated that the garment may confine one or more specialty skin products that are applied to an area of skin on the person's torso. It is also contemplated that the garment may protect a traditional garment top from contacting the one or more specialty skin products. The garment may further comprise a shorts portion for providing coverage of a person's hips, buttocks, and a portion of his or her legs. The garment may overlap a top area of a traditional bottom garment (e.g., to provide additional coverage but not to hold up, connect to, or support the bottom garments) and provide sufficient coverage of the protruding belly portion and the person's back so the skin of his or her torso is not exposed if the traditional garment top rises due to the growing belly.

The teachings herein include a method of providing a gentle lift to a belly portion (e.g., a protruding belly portion, such as that of a pregnant woman). The teachings may comprise the steps of providing a generally cylindrical garment of stretchable and/or compressive material with one or more ribbing sections; encircling a torso portion of a person with the generally cylindrical garment; stretching the generally cylindrical garment over the protruding belly portion; and positioning the one or more ribbing sections underneath the protruding belly portion to provide support. The one or more ribbing sections may extend 360 degrees or less around the generally cylindrical garment. The generally cylindrical garment may have one or more ruching sections, which allow the generally cylindrical garment to stretch vertically to cover the person's protruding belly portion while preventing the generally cylindrical garment from stretching vertically in the portion covering the person's back. The method may further comprise a step of locating the one or more ruching sections at the back of the woman prior to the stretching step. The method may further comprise a step of applying one or more specialty skin products to an area of skin of the torso portion prior to the stretching step. The generally cylindrical garment may confine the one or more specialty skin products to the area of skin of the torso portion. The generally cylindrical garment may protect the traditional garment top from contacting the one or more specialty skin products. It is contemplated that the generally cylindrical garment may be worn underneath a traditional garment top, and the generally cylindrical garment may overlap a top area of a traditional bottom garment (e.g., without connecting to or holding up the traditional bottom garment). The generally cylindrical garment may provide sufficient coverage of the protruding belly portion and the person's back so the skin of his or her torso portion is not exposed if the traditional garment top rises due to the size of the belly or movements of the person (e.g., raising a hand or reaching up).

It is thus among the objects of the invention to provide a garment that extends the use of specialty skin products, protects traditional garments, provides light lift and support to the weight of a person's belly, and provides additional coverage of skin as an extension for tops, such as blouses or shirts. This and other objects, advantages and features of the invention will be apparent from the following description of a preferred embodiment, considered along with the accompanying drawings.

DETAILED DESCRIPTION

Figure 1:
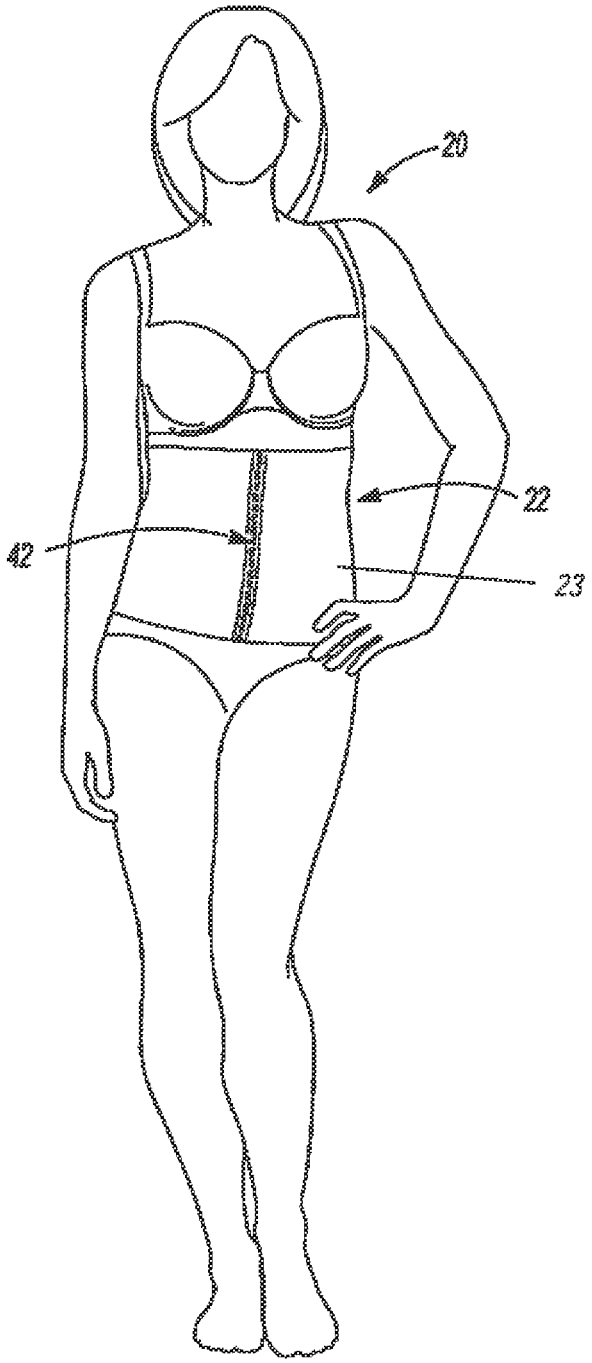
FIG. 1 shows a garment comprising a band worn around the torso of a person according to the present teachings.

The teachings herein make advantageous use of apparel, specifically a stretchable and/or compressive undergarment, which can be worn in such a way as to confine specialty skin products to the torso, legs, hips, buttocks, or combination thereof, of a person (e.g., a pregnant woman) and guard traditional garments worn over it from coming in contact with the specialty skin products. The stretchable and/or compressive undergarment may also include design elements to provide gentle lift and support for the weight of a person's belly; to provide light compression to the torso, hips, buttocks, or thighs; to provide a smoother appearance to skin in the torso, hips, buttocks, thighs; or combination thereof. The stretchable and/or compressive undergarment may further act as a shirt extension, providing additional coverage of exposed skin that shorter or traditional tops, such as shirts or blouses, cannot. Any, all, or a combination of the features disclosed herein is contemplated to be within the scope of the teachings.

The present teachings include a garment including a band to be worn around the torso, hips, buttocks, thighs, or combination thereof of a person (e.g., a pregnant woman, a woman post-pregnancy, a person undergoing bodily changes such as weight loss or gain, a person desiring additional support and/or compression for his or her body, and the like). Preferably, the garment is a flexible garment with sufficient elasticity to stretch over parts of the person's body such as the torso (e.g., a growing pregnant belly). The garment may be of sufficient dimensions to provide coverage of a portion or all of a person's torso, such as a protruding belly. The garment may also be of sufficient dimensions to provide coverage for an area below the belly, such as a person's waist, hips, buttocks, portion of his or her legs, or combination thereof. The garment, as described herein, contemplates different features, all of which, alone or in combination, are within the scope of the teachings. The garment may have features, such as a portion of additional material to serve as a shirt extender to provide additional coverage to the belly portion, hips, thighs, buttocks, or combination thereof. The shirt extender may be at least substantially free of any capability of holding up a garment worn on the lower half of the body. The garment may have additional material joining the front and rear of the garment with openings for accommodating and/or providing coverage for a person's hips, thighs, and buttocks. The garment may be of sufficient dimensions to provide coverage above a person's belly (e.g., a protruding belly, such as a pregnant belly), including an area of the person's ribcage or below the person's chest (e.g., a woman's breasts). The garment may provide partial or full coverage of a woman's breasts, which may also include partial or full support to the woman's breasts (e.g., with one or more of built-in cups, ribbing, underwires, and the like). Any embodiment of the garment may also have one or more straps to attach to a woman's bra or to be worn on a person's shoulders or around his or her neck to provide additional support to the weight of the person's belly and back and to assist in holding the garment in the proper position. These straps may be adjustable in length, removable, repositionable, convertible, or combination thereof.

The dimensions of the band of the garment preferably include about 6 inches to about 30 inches in height, more preferably about 9 inches to about 22 inches in height, wherein the height of the garment is the distance between a point at the top edge of the garment and the associated point directly below (e.g., in a vertical line) at the bottom edge of the garment, though additional length is also contemplated, especially for taller people. When stretched vertically, the height between any two points in a vertical line may increase by about 1.1× or more, about 1.25× or more, about 1.5× or more, about 2× or more, or even about 3× or more. The height may increase by about 10× or less, about 7× or less, about 5× or less, about 4× or less, or even about 3.5× or less. Additional height is within the scope of the teachings for garments with a bottom featuring two openings to accommodate each of a woman's legs. For example, the garment may extend downward to form shorts having two leg portions, wherein each leg portion may encircle at least a portion of the person's thigh. The garment may provide full or partial coverage of the person's buttocks, hips, legs, or combination thereof. The cut of the openings of the bottom portion may resemble briefs, a thong, boy shorts, shorts covering the upper thigh, shorts extending to the mid thigh, shorts extending to the knee, or of a length that is capri length, extending to the ankle, or the like.

The height of the band of the garment may be constant around the entire band. The height may vary at different points of the band (e.g., greater height along the portion that fits over the belly and lesser height in the area that covers the person's back). Other features of the band and/or garment may alter the height at different points along the band. For example, the band may be a generally uniform height around the entire band, but adding one or more ruching sections may shorten the height of the band in a particular area. When the one or more ruching sections are stretched vertically, the band may again be a more uniform height. The band may have generally straight and/or linear edges at the top edge of the band and/or bottom edge of the band. The edges of the garment may have generally curved segments, linear segments, scalloping, lace, decorative shapes or cutouts, or combination thereof. For example, the garment may have a generally convex arcuate segment at the top edge in the front to cover the top of the belly, or the garment may have one or more generally concave arcuate segments at the top edge to be positioned below and accommodate the shape of a person's chest (e.g., a woman's breasts). The garment may have one or more generally convex or generally concave arcuate segments at the bottom edge for more or less length in particular areas of the garment (e.g., to provide additional length in the front and/or rear for more coverage if the person lifts his or her arms, which raises his or her shirt, or to keep up with fashion trends such as more length in the rear to provide coverage of the person's buttocks). The bottom edge may generally flare out, such as to provide coverage but not compression to lower areas. The bottom edge may instead include material or fabric joining the front and rear of the garment with two openings to accommodate the woman's legs. The edge of each opening may be generally uniform around the woman's leg (e.g., the same height around her leg) or the edge may vary depending on the cut (e.g., cut higher in the front than in the rear to expose part of the front of the thigh but cover the buttocks).

The band of the garment preferably has a circumference that will accommodate a person of a designated size range. For example, the band/garment may accommodate a pregnant woman and/or a woman post-pregnancy seeking to return to her pre-pregnancy measurements. The band/garment may accommodate a person who is not pregnant or was not pregnant recently. Preferably, the band/garment is a generally cylindrical shape. The garment may have a generally cylindrical shape in the band area covering the person's torso and may have fabric joining the front and rear of the garment and forming two openings toward the bottom of the garment to accommodate a person's legs and provide coverage to the person's buttocks, hips, thighs, or combination thereof. The portions of the garment encircling the person's legs may also be generally cylindrical to provide additional coverage to at least a portion of the person's legs (e.g., extending to the woman's mid thigh or knee).

The circumference of the torso portion of the garment (e.g., the band) may be from about 18 inches to about 40 inches. When stretched horizontally, the circumference may increase by about 1.1× or more, about 1.25× or more, about 1.5× or more, about 2× or more, or even about 3× or more. The circumference may increase by about 10× or less, about 7× or less, about 5× or less, about 4× or less, or even about 3.5× or less. The circumference along the entire generally cylindrical band may be generally constant. The circumference along the entire generally cylindrical band may vary. The circumference at the top edge of the generally cylindrical band may be greater than, less than, or approximately equal to the circumference at the bottom edge of the garment. The garment may have a greater circumference in the area that covers a belly portion, such as a growing pregnant belly. The garment may have a different circumference at a particular feature of the garment from the circumference at the top edge of the band, the bottom edge of the band or garment, or both (e.g., at one or more ribbing sections of the garment, the circumference may be smaller than the circumference at the top edge of the band, bottom edge of the band or garment, or both). The circumference at the bottom edge of the generally cylindrical garment may be greater than the circumference at the top edge of the garment and/or the circumference at the ribbing sections. A lower portion of the garment may increase in circumference as it approaches the bottom edge of the garment (e.g., the material may extend from the ribbing section with a gradually increasing circumference it approaches the bottom edge of the garment, or may flare out). To provide additional support to the body, such as a belly, and to remain in proper position on the person's body, the parts of the garment with ruching sections may have a smaller circumference than the circumference of the top edge and/or the bottom edge of the garment.

Figure 13:
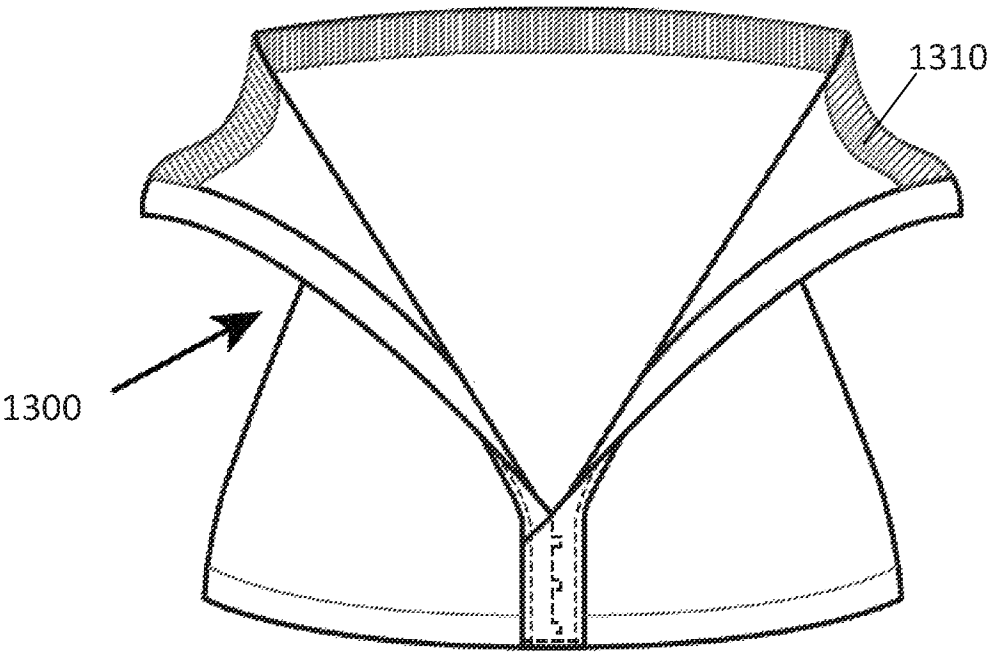
FIG. 13 illustrates a garment with a ribbing section located on the inside of the garment according to some embodiments of the present invention.

The garment may have one or more ribbing sections. Preferably, the garment has ribbing that extends at least partially around the circumference of the band. preferably located at least at the front of the band or located around the entire circumference of the band. The ribbing is preferably located toward the base of the band so when the band is worn around the torso of a person, the ribbing section is located under the belly (e.g., the protruding portion of a pregnant belly) to provide gentle lift and support. Preferably, the ribbing section is located in the bottom half of the garment, and more preferably, the ribbing section is located at or near the bottom third of the garment. The ribbing section may have a height of about ½ inch to about 8 inches, more preferably about 1 inch to about 4 inches around the garment. The one or more ribbing sections may comprise a plurality of vertical ribs, one or more horizontal ribs, or combination thereof. The ribs may be of any width. The ribbing section may have a thickness that is generally greater than the thickness of the other portions of the garment, less than the thickness of the other portions of the garment approximately equal to the thickness of the other portions of the garment, or combination thereof. The ribs may be located on the inside of the garment, contacting the skin; on the outside of the garment; or both. The thickness of the one or more ribbing sections and location of the ribbing (e.g., on the inside, as illustrated in FIG. 13, outside, as illustrated in FIGS. 2-6, or both) may be dependent on upon the amount of support desired for the person's body, such as protruding portion of the person's belly.

The garment may be made with ruching. The ruching may be located on the rear side of the band, e.g., so it can be worn on the person's back. This ruching may allow the band to expand vertically in the front, where weight is carried by the person (e.g., a person's belly or as a woman's pregnant belly grows), while remaining in place lower on the person's back for comfort and support. The garment may have more than one section of ruching (e.g., there may be double ruching, triple ruching, or more). The ruching may be about 4 inches to about 18 inches in length, and more preferably about 6 inches to about 12 inches in length. Each ruching section may run the entire length of the band or the entire length of the garment. Each ruching section may begin at or near the top edge and run to an area around the bottom of the person's torso (e.g., ruching stopping before reaching the woman's buttocks and/or the shorts portion of an embodiment of the garment). The ruching may begin at the top edge of the garment and/or band or slightly below the top edge (e.g., below a hem at the top of the garment) and run downward to the ribbing section. The ruching sections may be located on opposing sides of the generally cylindrical garment (i.e., at the endpoints of the diameter). When the garment is worn, the ruching segments may be located on a person's sides, on or toward the person's back, or both. The ruching sections may be located on the rear side of the garment. The ruching sections may be located about 1 inch apart or more, about 3 inches apart or more, or about 5 inches apart or more. The ruching sections may be located about 18 inches apart or less, about 14 inches apart or less, or about 12 inches apart or less.

The garment (e.g., the band) preferably can be expanded and stretched to be firmly but comfortably worn around the torso of a person. To provide light compression and support for the belly and to hold in moisture, such as lotions, the fabric of the garment preferably has a weight of about 1.5 oz/yd$^2$ or greater, and more preferably about 4 oz/yd$^2$ or greater. Preferably the fabric has a weight of 12 oz/yd$^2$ or less, and more preferably about 10 oz/yd$^2$ or less. The garment may comprise a smooth knit fabric. The fabric may be a woven material. The fabric may be a non-woven material. The garment may be made of a breathable fabric, stretchable fabric, compression fabric, flexible fabric, elastic fabric, or combination thereof. The garment may comprise any combination of polyester, polyamide such as nylon, elastane/spandex, cotton, bamboo, modal, rayon, lyocell such as Tencel, other man-made materials, the like, or combination thereof. The garment is preferably a breathable knit fabric, such as nylon or spandex (e.g., Lycra®). Preferably, the garment comprises a nylon/Lycra® spandex blend. The garment composition may include nylon, polyester, or a blend thereof present in an amount from about 20% to about 99%, or from about 75% to about 90%. Spandex may be present in an amount from about 0% to about 40% of the garment composition, or about 10% to about 20%. The garment composition may also include cotton, bamboo, modal, rayon, Tencel, polyester, nylon, or a blend of two or more thereof in an amount of about 2% to about 50%. Benefits of the fabric disclosed herein include, but are not limited to, being easy to clean and being resistant to fungi, molds, mildew, and chemicals.

The garment may comprise a moisture locking material. This moisture locking material may be a lining in the interior of the generally cylindrical garment (e.g., the band) and may contact the skin to confine the specialty skin products to the torso or the desired areas of the skin of the belly. The moisture locking material may be part of or integrated into the knit fabric. The moisture locking material may also keep external moisture out and away from the covered skin of the user. The moisture locking components, such as nylon, polyester, and other fibers such as rayon, bamboo, Tencel, and the like, allow moisturizers or other products to seep into the skin and opposed to being absorbed by the fabric. Moisturizers or other products include but are not limited to lotions, creams, gels, cleansers, scrubs, butters, oils, jellies, emollients, and humectants, or any combination thereof. Moisture locking components also allow the garment to be easily cleaned to remove residual moisturizer that was applied to the person's skin.

The garment may comprise a moisture wicking material to pull moisture such as sweat and perspiration away from the person's skin. This may help keep the person cool in hot or humid conditions, or it may help keep the person warm in cool temperatures. A composition of about 20% or more of polyester, nylon, or any yarns with wicking properties, including derivative yarns made from a blend of polyester and/or nylon, or any yarns treated to have wicking properties may be used to achieve results with or without spandex. The garment may also have quick drying capabilities. The quick dry components, such as nylon or other fiber contents, allow the person to feel comfortable wearing the garment all day with moisturizers, creams, oils, and the like, remaining in place.

The garment may be a seamless garment. The garment may have one or more seams. The garment may include one or more hems (e.g., a hem at the top edge of the garment and/or a hem at the bottom edge of the garment to reduce the risk of the edges of the garment fraying). The garment may be of a single material. The garment may be formed from a single piece of fabric. The garment may be formed from multiple pieces of fabric. The garment may comprise panels of different materials joined at the one or more seams (e.g., one elastic, stretchable material for the portion of the garment above the one or more ribs, and another material below the ribbing section that serves as a shirt extension; or one material for the area of the garment contacting the user and another material on the outside of the garment). The garment (e.g., the band) may be secured around the person's torso with a fastener (e.g., Velcro, clasps, snaps, buttons, zippers, hook and eye fasteners, the like, or combination thereof). The garment may have elastic, ribbing, an anti-slip or tacky substance (e.g., silicone band and/or lining), or other feature or combination of features at the top of the band, at the ribbing sections, along a portion or all of one or more sides of the garment, and/or at the bottom of the band/garment to hold the garment in place while the person is wearing it. The garment or portions of the garment may be any color or colors. Including basic colors like black, nude, gray, white, and the like, or more vibrant colors. The garment may be a solid color. The garment may have a pattern (e.g., striped, checkered, seasonal, tie dye, flowered, and the like). Different colors or patterns may be used in different areas of the garment. For example, a top portion (e.g., above the ribbing section) may be one color, such as nude, while the bottom portion (e.g., the portion below the ribbing section serving as a shirt extender) may be a different color to match a particular outfit or add further style to the woman's ensemble. The garment may include one or more textured portions on the inner side (e.g., against the user), on the outside (e.g., away from the user). The textured portion may be for decoration, may hold the garment in place on the user, may hold the traditional garment top in place (e.g., resisting movement through increased friction between materials), or combination thereof.

The garment, or at least a portion of the garment, may be of a stretchable and/or compressive material that can be worn throughout the different stages of a person's weight gain or loss. For example, the garment may be worn during pregnancy or after pregnancy. The garment may be worn by someone undergoing weight loss, such as through diet and exercise or surgery, such as bariatric surgery. A single garment may be worn during most stages or every stage of the person's bodily changes, such as during a woman's pregnancy or following a surgery. A person may instead wear a different garment during the stages. For example, a woman may wear a different garment during the stages of her pregnancy (e.g., a larger garment as she progresses in her pregnancy, or a smaller garment after the baby is born). The garment may be one-size-fits-all. The garment may be offered to the consumer in varying sizes (e.g., sizes designated by Small, Medium, Large, etc., or based on a person's specific measurements), which may be helpful as the person's body changes (e.g., as the person loses or gains weight, as a woman progresses in her pregnancy (e.g., a size Small while in the first trimester and a larger size while in the third trimester)). The sizing may also be determined by the size of the belly, for example based on the number of babies a pregnant woman is carrying (e.g., single child or multiples, such as twins), or other factors. The garment may also be worn post-pregnancy for slight compression, smoothing, and for holding lotions in place.

Figure 2:
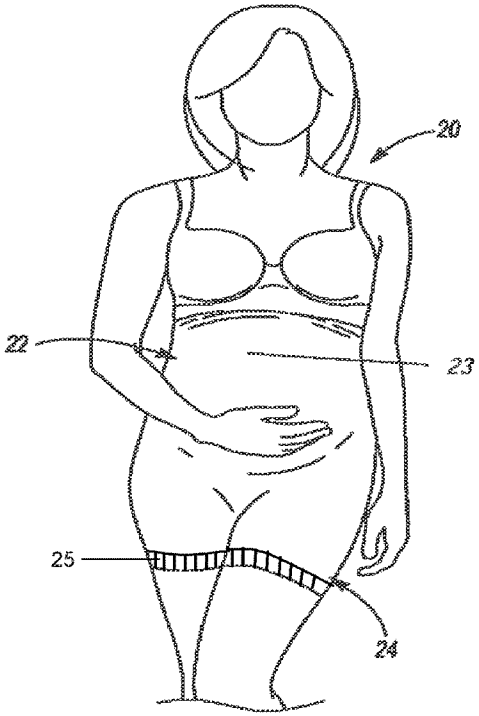
FIG. 2 shows a garment providing coverage of a person's buttocks, hips, and thighs according to the present teachings.

Referring now to the figures, FIG. 1 shows a person 20 wearing a garment 22 around her torso. The garment 22 includes a generally cylindrical band 23 and provides coverage of the torso of the person 20. The garment 22 is secured around the torso with a fastener 42, for example a plurality of hook and eye fasteners. FIG. 2 shows a frontal view of a person 20 wearing the garment 22 during pregnancy (though the teachings are not limited to pregnant women). The garment 22 provides coverage, slight compression, shaping, lifting and smoothing of the torso by the band 23, and also provides the same for the thighs, hips, and buttocks through the shorts portion 24.

Figure 3:
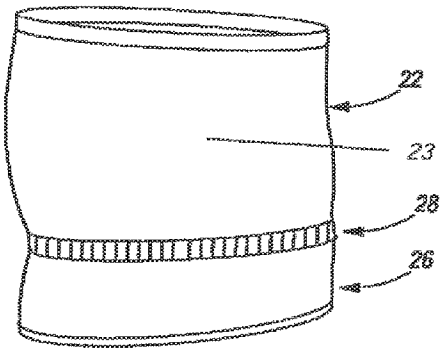
FIG. 3 shows a side view of a garment with a shirt extender feature according to the present teachings.
Figure 4:
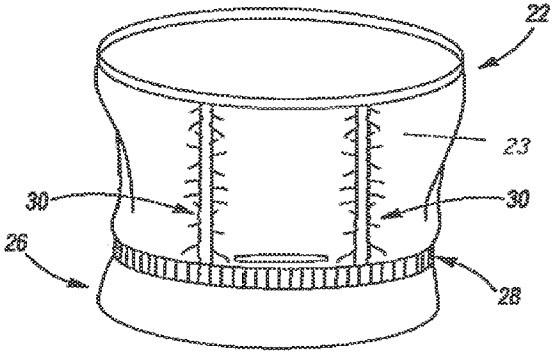
FIG. 4 shows a rear view of the garment of FIG. 3.
Figure 5:
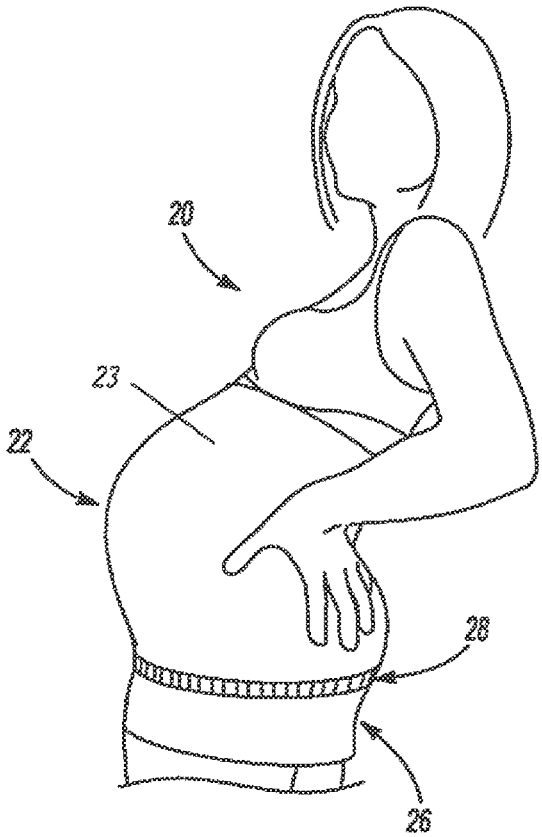
FIG. 5 illustrates a person with her belly being supported and/or lightly lifted by the garment.
Figure 6:
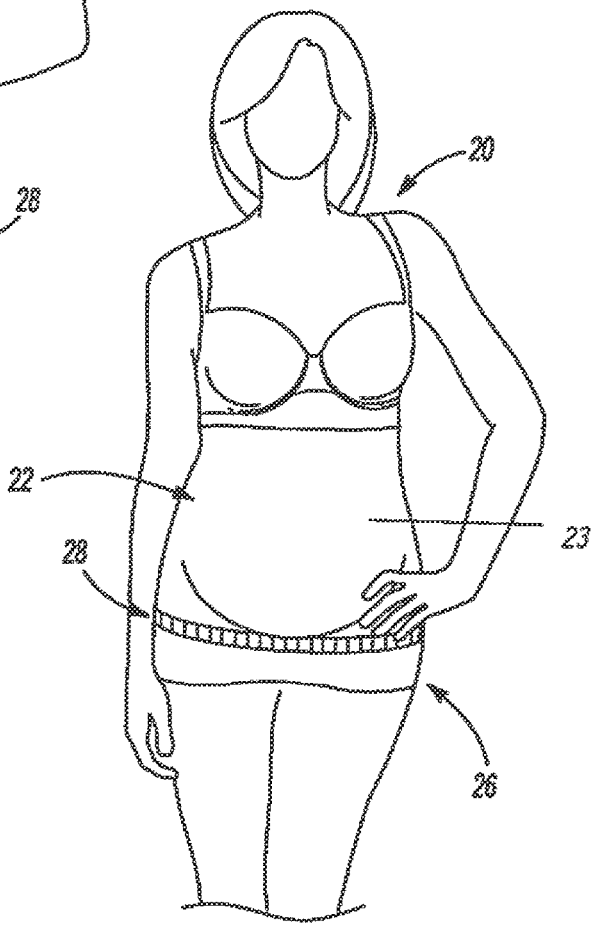
FIG. 6 shows a frontal view of a person wearing the garment of FIG. 5.

FIGS. 3 and 4 show a side and rear view, respectively, of the garment 22 with the band 23 worn around the torso and a shirt extender portion 26. The garment 22 also includes ribbing 26 at the base of the garment 22. The rear view of the garment 22 in FIG. 4 also shows double ruching 30, which allows the garment 22 to expand vertically in the front (e.g., as the pregnant belly grows), while remaining lower on the back to provide comfort and support to the person, FIGS. 5 and 6 show a side view and a frontal view of a person 20 wearing the garment 22 as shown In FIGS. 3 and 4. The figures show the person 20 wearing a garment 22 with ruching 30 (see FIG. 4) in the band 23. The garment 22 is relatively confined to the lower back of the person 20, avoiding the upper back and underarm area. The ribbing 28 at the base of the garment 22 provides light lift and/or support underneath the protruding portion of the belly, which helps alleviate some of the discomfort caused by the belly being pulled downward due to the weight and/or as it grows. The shirt extender portion 26 provides additional length and coverage to avoid exposed skin in the event that the person's shirt lifts. In other embodiments, the ribbing section may be located as shown in FIG. 2., i.e., the ribbing section 25 may be located on the shorts portion 24 as illustrated in FIG. 2.

Figure 7:
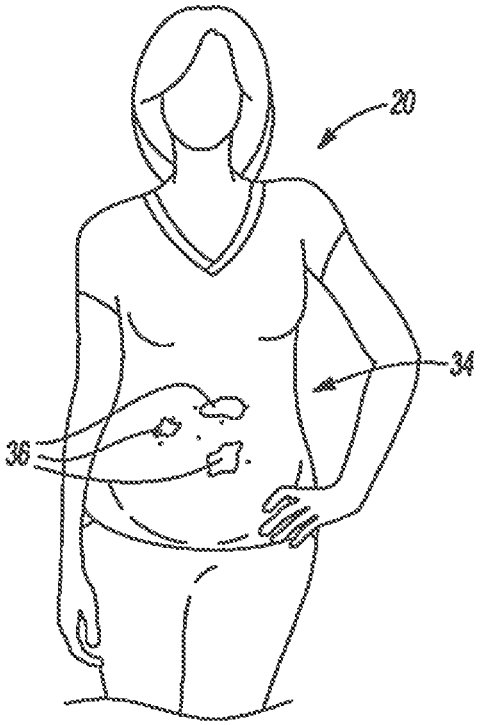
FIG. 7 illustrates a person wearing a traditional garment top with stains caused by the dissipation and transfer of specialty skin products from the skin to the traditional garment top.

FIG. 7 shows the problem with applying specialty skin products without the garment as disclosed herein. The person 20 is wearing a traditional top 34, such as a shirt or blouse, with stains 36 caused by specialty skin products coming into contact with and being absorbed by the traditional top 34. The garment acts as a barrier, confining any specialty skin products to the torso and/or hips, thighs and buttocks, and reducing dissipation of the specialty skin products, thereby extending the life of the potentially expensive products, reducing the need to reapply specialty skin products, and protecting the garments from potential deterioration or discoloration caused by ingredients used in specialty skin products.

Figure 8:
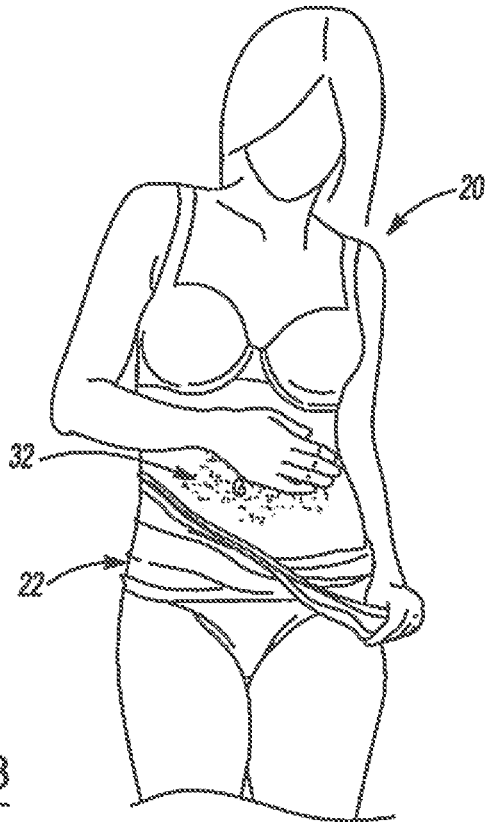
FIG. 8 illustrates a person applying a specialty skin product prior to wearing the garment in an intended position on her torso.
Figure 9:
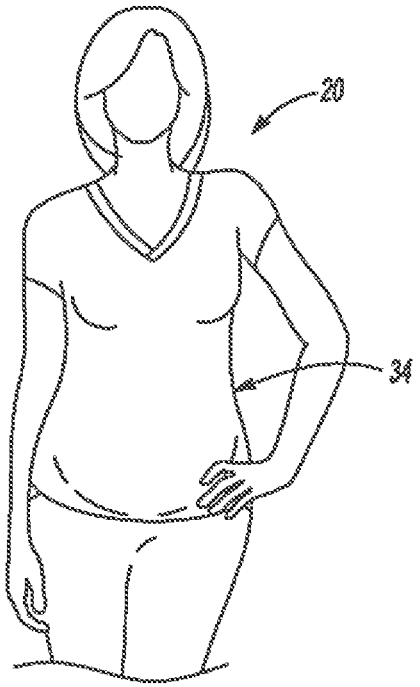
FIG. 9 illustrates a person wearing a traditional garment top without stains, showing the protection provided by the garment disclosed herein.
Figure 10:
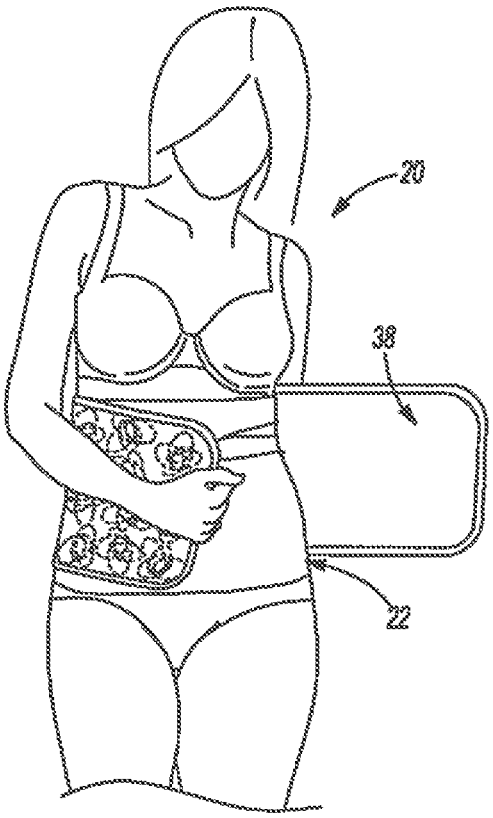
FIG. 10 illustrates a person, wearing the garment as disclosed herein underneath a compression garment.

FIG. 8 shows how a person 20 may apply specialty skin products 32 to his or her skin prior to covering his or her torso with the garment 22. This figure shows the garment 22 covering a portion of the person's hips. The garment may provide coverage of the hips and buttocks and upper thigh region before it has been pulled up to cover the woman's belly portion. The wearer can step into the center of the garment and pull the generally cylindrical garment up over his or her legs, buttocks, and hips to cover his or her belly. It is also contemplated that the wearer can pull the garment over his or her head and shoulders and down his or her body to cover his or her belly. With a garment including a shorts portion (as shown in FIG. 2), a wearer can step with one foot into each opening and pull the garment up over his or her legs, buttocks, hips, and belly. The teachings also include a garment that can be wrapped around the person's torso and secured with a fastener (e.g., Velcro, clips, snaps, buttons, zippers, hook and eye fasteners, and the like). FIG. 9 shows a person 20 wearing a traditional top 34 without stains, illustrating a benefit to utilizing the present teachings underneath clothing. As shown in FIG. 10, the garment 22 can also be worn underneath a compression garment 38, such as a Belly Bandit® wrap product or other shapewear from Belly Bandit®, to protect the compression garment from stains and deterioration and provide additional comfort to the person 20.

Figure 11:
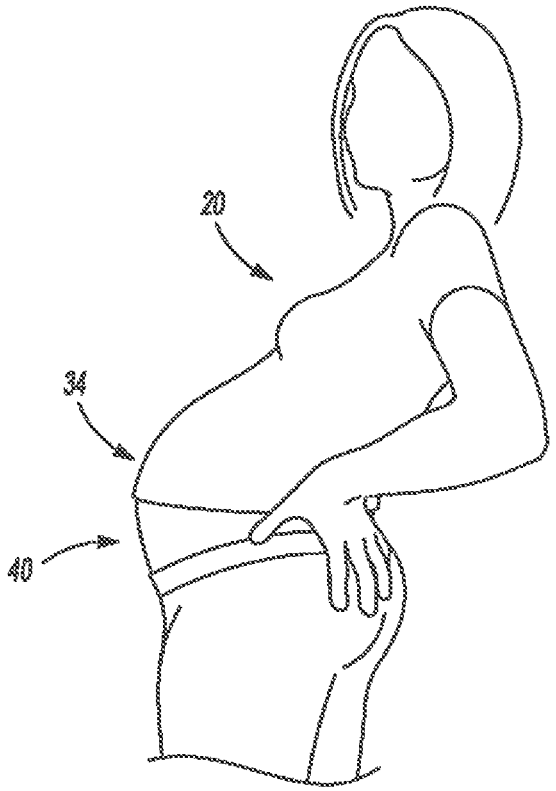
FIG. 11 illustrates a person wearing a traditional garment top and exposing skin between the bottom of the traditional garment top and the waistband of the bottoms.
Figure 12:
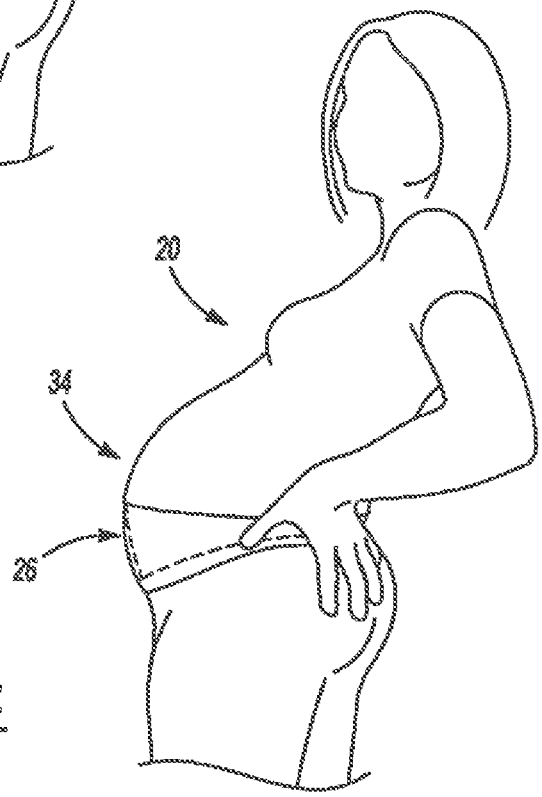
FIG. 12 illustrates a person wearing a traditional garment top over the garment as disclosed herein, with the garment overlapping the waistband of the bottoms.

FIG. 11 shows a problem with a traditional top 34, such as a blouse or shirt When the traditional top 34 is worn by a person 20, the size of the belly and/or movements by the person can lift the traditional top 34, exposing skin 40 between the bottom of the traditional top 34 and the waistband of her bottoms, such as pants or a skirt. FIG. 12 shows the improvement effect of a person 20 wearing a traditional top 34, such as a blouse or shirt, with the shirt extender portion 26 of the garment reducing or eliminating the risk of exposed skin and overlapping the waistband of her bottoms.

FIG. 13 illustrates a garment 1300 with a ribbing section 1310 located on the inside of the garment 1300.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims. While this disclosure is focused primarily on a pregnant woman's body, it is contemplated that this garment may also be used by persons who are not pregnant, men or women, who are looking for a garment to protect traditional garments from specialty skin products, provide a shirt extension, provide support for the lower back and belly, or to provide additional smoothing, compression and shaping of hips, thighs, and buttocks. Furthermore, the words man, woman, user, person, wearer, and variations of these words herein are meant to be synonymous, and use of any of these words does not exclude the others unless otherwise stated.

As used herein, unless otherwise stated, the teachings envision that any member of a genus (list) may be excluded from the genus; and/or any member of a Markush grouping may be excluded from the grouping.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for ail purposes. The term "consisting essentially of to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist of, or consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. A maternity support garment comprising:

a stretchable compressive material;

one or more generally cylindrical shaped upper portions;

one or more generally cylindrical shaped base portions;

one or more ribbing sections located on at least one of the one or more generally cylindrical shaped upper portions or base portions;

wherein the maternity support garment including the one or more ribbing sections is configured to encircle at least a portion of a torso of a user, wherein the one or more ribbing sections extends 360 degrees around the one or more generally cylindrically shaped upper portions or base portions; and wherein the maternity support garment is configured to cover at least a part of a front portion or a part of a side portion and at least a part of a back portion of the user.

2. The maternity support garment of claim 1, further comprising one or more areas of ruching of the stretchable compressive material on a portion of the maternity support garment configured to cover at least one of at least a part of the front portion, a part of the side portion, and a part of the back portion of the user.

3. The maternity support garment of claim 2, wherein the ruching allows the maternity support garment to expand in a portion configured to cover at least a part of the front portion or a part of the side portion of the user while preventing the maternity support garment from expanding in a portion configured to cover at least a part of the back portion of the user.

4. The maternity support garment of claim 1, wherein the maternity support garment further comprises a moisture locking material.

5. The maternity support garment of claim 1, wherein the maternity support garment has one or more seams to form the one or more generally cylindrical shaped upper or base portions.

6. A method of providing support to a body part of a user comprising:

providing a maternity support garment with one or more generally cylindrical shaped upper and base portions with one or more ribbing sections located on the one or more generally cylindrical upper portion or base bottom portions, wherein the one or more ribbing sections extends 360 degrees around the one or more generally cylindrically shaped portions;

configuring the maternity support garment to encircle at least a portion of a torso of the user;

configuring the maternity support garment to cover at least a part of a front portion or a part of a side portion and a part of a back portion of the user; and positioning the one or more ribbing sections in the one or more generally cylindrical upper portions or base portions of the maternity support garment.

7. The method of claim 6, wherein the maternity support garment has one or more ruching sections, the one or more ruching sections allowing the maternity support garment to stretch in a portion configured to cover at least a part of the front portion or a part of the side portion and a part of the back portion of the user while preventing the maternity support garment from stretching in a portion configured to cover the back portion of the user.

8. The maternity support garment of claim 1, wherein the maternity support garment has at least one seamless portion.

9. The maternity support garment of claim 1, wherein the maternity support garment comprises moisture wicking material.

10. The maternity support garment of claim 1, wherein the maternity support garment comprises quick dry capabilities.

11. The maternity support garment of claim 1, wherein the maternity support garment compromises multiple pieces of fabric.

12. The maternity support garment of claim 1, wherein the one or more ribbing sections are located both inside and outside the maternity support garment.

13. The maternity support garment of claim 1, wherein the one or more ribbing sections provides support to a belly portion of the user.

14. The maternity support garment of claim 1, wherein the one or more ribbing section is located on the outside of the maternity support garment.

15. The maternity support garment of claim 1, wherein the one or more ribbing section is located on the inside of the maternity support garment.

16. The maternity support garment of claim 11, wherein at least one piece of fabric provides compressive support to a belly portion of the user.

17. The maternity support garment of claim 1, wherein the one or more ribbing sections extend from the upper portion to the base portion of the maternity support garment in at least a portion of the maternity support garment configured to cover at least one of a part of the front portion, side portion, and back portion of the user.

18. The maternity support garment of claim 1, wherein the one or more ribbing sections has at least two different heights at different portions of the maternity support garment configured to cover at least one of a part of the front portion, side portion, or back portion of the user.

19. The method of claim 6, wherein the one or more ribbing sections has at least two different heights at different portions of the maternity support garment configured to cover at least one of a part of the front portion, side portion, and back portion of the user.

20. The maternity support garment of claim 2, wherein the ruching allows the maternity support garment to expand in a portion configured to cover at least one of a part of the front portion, a part of the side portion, and a part of the back portion of the user.

* * * * *